United States Patent [19]

Miner

[11] Patent Number: 4,861,033

[45] Date of Patent: Aug. 29, 1989

[54] PRACTICE PUTTING CUP

[76] Inventor: Robert A. Miner, P.O. Box 650460, Vero Beach, Fla. 32965-0460

[21] Appl. No.: 215,154

[22] Filed: Jul. 5, 1988

[51] Int. Cl.[4] ..... A63B 69/36

[52] U.S. Cl. ..... 273/177 R; 273/183 E; 273/192

[58] Field of Search ..... 273/177 R, 177 A, 177 B, 273/179 R, 179 A, 179 B, 179 C, 179 D, 179 E, 180, 184 A, 183 E, 192, 185 R

[56] References Cited

U.S. PATENT DOCUMENTS 1,513,917 11/1924 Long ..... 273/178 A
3,114,556 12/1963 Miller ..... 273/178 R

FOREIGN PATENT DOCUMENTS 2073598 10/1981 United Kingdom ..... 273/184 A

*Primary Examiner*—George J. Marlo

*Attorney, Agent, or Firm*—Sughrue, Mion, Zinn, Macpeak & Seas

[57] ABSTRACT

A practice putting cup includes a circular disk having a pair of upstanding spaced apart wall portions, the ends of which are spaced apart to define an entry for a golf ball onto the surface of the disk. The edge of the disk between the ends of the wall portion is beveled and a pair of outwardly extending flanges are secured to the wall portions adjacent the entry to deflect the ball into the entry. A radially extending groove is formed in the upper surface of the disk which bisects the periphery of the disk between the end portions of the wall to assist the golfer in aligning his putting stroke and a radially extending slot is formed in the disk in alignment with the radially extending groove for detachably connecting a flexible line which may be extended beyond the periphery of the cup in alignment with the groove to define an imaginary putting line.

6 Claims, 1 Drawing Sheet

PRACTICE PUTTING CUP

BACKGROUND OF THE INVENTION

The present invention is directed to a practice putting cup and more specifically to a plastic cup adapted to be placed on a carpet or natural grass and having an alignment groove and slot bisecting the upper surface of the cup.

Practice putting cups are old and well known in the art and they are generally comprised of a flat disk having upstanding walls extending substantially about the entire periphery with the exception of an opening to allow the ball to enter the cup. Some practice putting cups include many additional features such as bells or lights to indicate the entrance of the ball into the cup and spring actuated or gravity dependant devices for ejecting the ball from the cup in the general direction of the person putting.

SUMMARY OF THE INVENTION

The present invention provides a new and improved practice putting cup having an alignment aid bisecting the ball opening in the cup to assist the golfer in maintaining the ball-contacting surface of a putter perpendicular to the desired path for travel of the ball.

The present invention provides a new and improved practice putting device comprising a flat disk having a pair of upstanding walls extending about two opposed edges of the disk with the ends of the upstanding walls being spaced from each other to allow the entry of a ball onto the upper surface of the disk, said disk having a beveled edge between the ends of said walls and a radially extending groove in the upper surface thereof bisecting the opening between a first pair of ends of said upstanding walls and a radially extending slot bisecting the distance between the second spaced apart pair of ends of said sidewalls with said groove and said slot lying on a common diameter of said disk.

The practice putting device may be of one-piece molded plastic construction with depending spike-like projections to hold the cup in place on a carpet or on natural grass.

The present invention provides a new and improved practice putting cup wherein the groove and slot in the upper surface thereof to assist the golfer in aligning a putting stroke is especially adapted to be used in conjunction with the practice putting devices disclosed in the Applicant's prior U.S. Pat. Nos. 4,544,160 and 4,765,625.

The foregoing and other objects. features and advantages of the invention will be apparent from the following more particular description of a preferred embodiment of the invention as illustrated in the accompanying drawings.

DETAILED DESCRIPTION OF THE INVENTION

Figure 1:
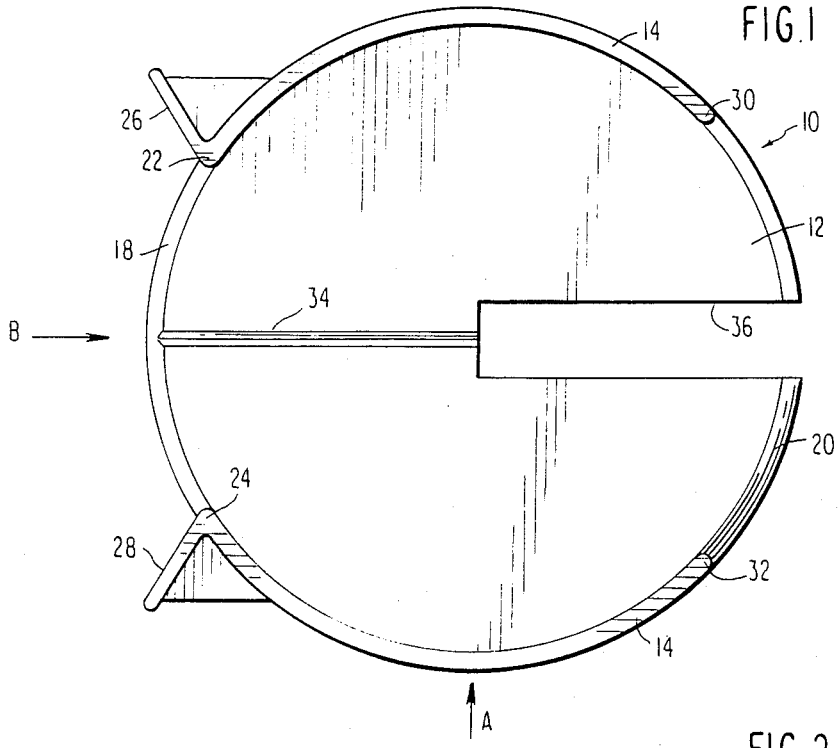
FIG. 1 is a top plan view showing the practice putting cup according to the present invention.
Figure 2:
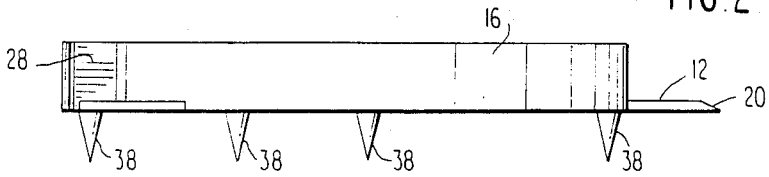
FIG. 2 is a side elevation view of the practice putting cup taken in the direction of the arrow A in FIG. 1.
Figure 3:
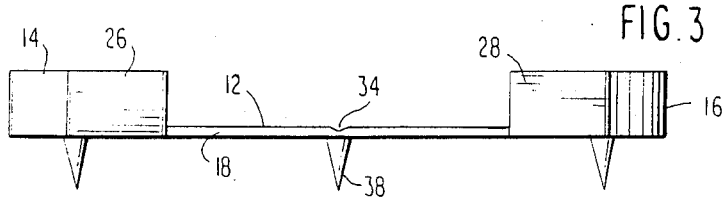
FIG. 3 is a side elevation view of the practice putting cup taken in the direction of the arrow B in FIG. 1.

The practice putting cup 10 is comprised of a circular disk 12 having a pair of upstanding sidewalls 14 and 16 which extend along two opposed portions of the periphery of the disk 12. The edges of the disk between the ends of the upstanding wall portions 14 and 16 are beveled at 18 and 20 to facilitate the rolling of a golf ball onto the upper surface of the disk 12. The ends 22 and 24 of the wall portions 14 and 16 are spaced apart a distance at least twice as great as the diameter of a standard golf ball to facilitate the entry of the golf ball onto the upper surface of the disk 12. A pair of outwardly directed flanges 26 and 28 extend outwardly from the ends 22 and 24 respectively of the wall portions 14 and 16 so as to deflect errant golf shots toward the entrance of the cup rather than have the balls bounce off the curved walls 14 and 16 away from the cup. The opposite ends of the walls 30 and 32 are also spaced apart.

A groove 34 is formed along a radius of the disk in the upper surface of the disk 12. The groove bisects the opening between the opposed ends 22 and 24 of the walls 14 and 16 respectively. The groove 34 provides an alignment sight-line along which a golfer can direct his putt by maintaining the contact face of the putter perpendicular to the longitudinal axis 34. A radially extending slot 36 is formed in the disk 12 along the same diameter as the groove 34.

A plurality of projections or pins 38 are formed on the lower surface of the disk 12 to hold the cup in position on the tufted surface of a carpet or on natural grass. The entire practice putting cup including the projections 38 may be of integral one-piece molded plastic construction.

Figure 4:
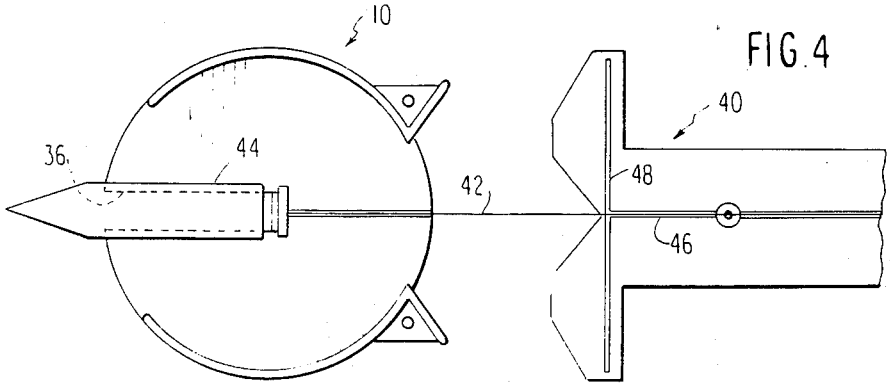
FIG. 4 is a top plan view showing the practice putting cup in combination with Applicant s prior practice putting device and means for aligning the cup and the device.

While the practice putting cup 10 according to the present invention can be used independently for practice putting. FIG. 4 shows the practice putting cup 10 according to the present invention in combination with Applicant's prior practice putting device 40 and a string for ensuring the alignment of the alignment markings on the cup and the device along the same line. The string 42 may be secured to a conventional plumb bob 44 which has a substantially cylindrical configuration. When using the plumb bob 44 the plumb may be laid in the slot 36 so that upon pulling the string 42 taut. the upper end of the plumb bob will engage the end of the slot 36. The string may be of any suitable length. It has been found that a string approximately nine feet long is suitable for carrying out the progressive putting program which helps a golfer to groove" his putting stroke. The string 42 is stretched taut along the groove 44 on the upper surface of the putting cup 10 and along the center line 46 of the practice device 40. Thus. the transversely extending marker 48 on the putting device 40 will extend perpendicular to the theoretical putting line along which the string 42 is stretched. Thus, the golfer can align the face of the putter with the marker 48 thereby ensuring that the face of the putter 48 will be perpendicular to the desired theoretical putting line for accurate placement of the ball into the practice putting cup 10. The practice device 40 may be placed at varying distances along the string 42 so that the golfer may progressively increase the distance from the cup of the present invention.

The string 42 and the plumb bob 44 are obviously removed prior to carrying out the practice putting strokes and they are only used for the alignment of the putting device 40 with the practice putting cup 10. It is also possible to use the practice device 40 with a standard hole on a putting green in which case the plumb bob 44 would be lowered into the hole in alignment with the center of the cup, the string 42 would be stretched taut in the desired direction. The string 42 could be secured to a peg or any other type of device in lieu of the plumb bob 44 in order to locate the string at the center of a conventional putting cup in a green or to anchor the string in the slot 36 of the putting cup or into the present invention.

While the invention has been particularly shown and described with reference to a preferred embodiment thereof, it will be understood by those in the art that various changes in form and details may be made therein without departing from the spirit and scope of the invention.

What is claimed:

1. A practice putting cup comprising a flat disk having a substantially circular periphery, a pair of spaced apart upstanding arcuate wall portions connected to the disk along the periphery thereof, each of said wall portions having first and second ends extending upwardly from said disk with the first ends of said wall portions being spaced apart a sufficient distance to provide a first opening for the entry of a golf ball onto the disk and radially disposed indicia formed on the disk and bisecting the distance between said first ends of said wall portions.

2. A practice putting cup as set forth in claim 1 wherein the periphery of the disk between said first ends of said wall portions is beveled to facilitate the entry of the golf ball onto the disk.

3. A practice putting device as set forth in claim 1 wherein said indicia is comprised of a groove formed in the upper surface of said disk and further comprising means on said disk for detachably securing one end of a flexible line which may be stretched taut in alignment with said radially disposed indicia to define an imaginary putting line beyond the periphery of said disk.

4. A practice putting cup as set forth in claim 3, wherein said means for anchoring a flexible line is comprised of a radially extending slot in said disk in alignment with the radially extending indicia.

5. A practice putting cup as set forth in claim 1, further comprising flange means secured to said first ends of said wall portions and extending outwardly from the periphery of said disk away from said indicia means for deflecting the golf ball towards said opening between said first ends of said wall portions.

6. A practice putting cup as set forth in claim 1, wherein the second ends of said wall portions are spaced apart substantially the same distance as said first ends to define a second opening for the exit of the golf ball from the disk with said first and second opening being diametrically opposed.

* * * * *